US005661298A

United States Patent [19]

Bateman

[11] Patent Number: 5,661,298

[45] Date of Patent: Aug. 26, 1997

[54] MASS SPECTROMETER

[75] Inventor: Robert H. Bateman, Knutsford, England

[73] Assignee: Micromass Limited, Manchester, England

[21] Appl. No.: 649,795

[22] Filed: May 17, 1996

[30] Foreign Application Priority Data

May 18, 1995 [GB] United Kingdom ..... 9510052

[51] Int. Cl.[6] ..... H01J 49/30

[52] U.S. Cl. ..... 250/281; 250/282; 250/296

[58] Field of Search ..... 250/281, 282, 250/296

[56] References Cited

U.S. PATENT DOCUMENTS

| | | | |
|---|---|---|---|
| 3,475,604 | 10/1969 | Noda et al. | 250/281 |
| 4,066,895 | 1/1978 | Iwanaga | 250/296 |
| 5,117,107 | 5/1992 | Guilhaus et al. | 250/281 |
| 5,194,732 | 3/1993 | Bateman | 250/294 |
| 5,198,666 | 3/1993 | Bateman | 250/294 |

OTHER PUBLICATIONS

"Mass Spectroscopy" (2nd ed.), Duckworth et al, CUP 1990 Chapter 5.

Proc. 42nd ASMS Conf. Mass Spectrom. 1994, p. 1034, R.H. Bateman, M.R. Green and G. Scott.

*Primary Examiner*—Jack I. Berman

*Attorney, Agent, or Firm*—Chilton, Alix & Van Kirk

[57] ABSTRACT

A mass spectrometer is provided having a plurality of analyzers and including at least one magnetic sector analyzer and, typically, an orthogonal-acceleration time-of-flight mass analyzer. Bypass means are provided so that by switching of the direction of the ion beam, the magnetic sector analyzer may be bypassed and the time-of-flight analyzer used either to analyse the beam of ions from the source or daughter ions produced by fragmentation of that beam.

13 Claims, 2 Drawing Sheets

MASS SPECTROMETER

BACKGROUND OF THE INVENTION

The invention relates to mass spectrometers, in particular to mass spectrometers having a plurality of analyzers and including at least one magnetic sector.

A mass spectrometer is an instrument for analyzing a sample by ionizing at least some of the sample and analyzing the ions formed according to their mass-to-charge ratios. Many different types of analyzers are used in mass spectrometers. These include the magnetic sector analyzer, in which ions are subjected co a magnetic field which disperses the ions according to their mass-to-charge ratio. Other analyzers include the quadrupole analyzer, in which a varying quadrupole field is used to selectively transmit only ions with a particular mass-to-charge ratio, and the time-of-flight analyzer which analyses ions according to their velocities. Many other types and subdivisions of types also exist such as the ion cyclotron resonance analyzer, the ion trap analyzer, the Wien Filter etc.

A typical mass spectrometer may contain one or more analyzers of the same or different types which are combined together in a way which optimizes the parameters of the instrument depending on its intended use. For example, in a double-focusing mass spectrometer, magnetic and electrostatic analyzers are combined to effect direction and velocity focusing (e.g. see Chapter 5 of "Mass Spectroscopy" (2nd ed.), Duckworth et al, CUP 1990). Double-focusing mass spectrometers, and electrostatic analyzers suitable for use in such mass spectrometers, are also disclosed in U.S. Pat. No. 5,194,732 and U.S. Pat. No. 5,198,666. Mass spectrometers are also known in which magnetic sectors are combined with quadrupole analyzers or with time-of-flight (TOF) analyzers.

A typical prior mass spectrometer having both a magnetic sector and a TOF analyzer is shown in FIG. 1 The mass spectrometer 1 comprises an ion source 2 which may be of any of a selection of conventional types, e.g. electron impact, chemical ionization, Electrospray or Field Desorption etc. A sample introduced into the ion source is ionized and a beam 3 of ions is formed which passes from the source through a source slit 4, an alpha-angle defining slit 5, a first electrostatic analyzer 6, a magnetic sector analyzer 7, and a second electrostatic analyzer 8. The combination of the velocity focusing due to the first and second electrostatic analyzers and the momentum focusing due to the magnetic sector gives rise to a double-focused mass-dispersed ion image at a collector slit 9. An off-axis ion detector 10 is disposed downstream of the collector slit 9 and produces an electrical signal indicative of the number of ions in a given range of mass-to-charge ratios which pass through the collector slit.

A time-of-flight (TOF) analyzer 11 is also disposed downstream of the collector slit 9. Only ions whose mass-to-charge ratios fall within a range determined by the width of the collector slit 9 pass into the TOF analyzer 11 at any one instant. A collision cell 13 containing an inert gas at a relatively high pressure is disposed in the path of the ion beam 12 between the collector slit 9 and the TOF analyser 11 to cause controlled fragmentation of the ions passing through the collector slit 9. Structural information may then be obtained by TOF mass analysis of the daughter ions so formed. Since daughter ions formed by high energy collisions all have the same velocity but typically have different axial energies, an orthogonal-acceleration TOF mass analyzer is well-suited for the analysis of these collision products. A second off-axis ion detector 14 is disposed downstream of the TOF analyser 11.

Operation of the orthogonal-acceleration TOF analyzer portion of the mass spectrometer shown in FIG. 1 is as follows. Ions 12 of a selected mass-to-charge ratio enter the collision cell 13 and are fragmented by collisions with molecules of the inert gas. Daughter ions so formed pass through a deceleration region 15 and an extraction region 16. The potential of a repeller electrode 17 is pulsed in such a way that a packet of ions is repelled from it and travels towards a third ion detector 18. Measurement of the time interval between the electrical pulse applied to the repeller electrode 17 and the arrival of the packet of ions received at the detector 18 allows the mass-to-charge ratio of the daughter ions to be determined.

Such an instrument is described by R. H. Bateman, M. R. Green and G. Scott in Proc. 42nd ASMS Conf. Mass Spectrom. 1994, p 1034.

The prior instrument of FIG. 1 offers many advantages over a magnetic sector instrument. For example, the use of a magnetic sector offers unit mass ion selection with high transmission whereas the TOF analyzer offers the potential for high sensitivity and the acquisition of a full product ion spectrum. However, the TOF analyzer 11 cannot be used to mass analyze the ion beam 19 from the magnetic sector spectrometer because only ions of a limited range of mass-to-charge ratios can be transmitted through the collector slit 9 to the TOF analyzer 11 at ally instant. This limitation applies to any spectrometer comprising a magnetic sector in combination with one or more other analyzers, in that the magnet will always introduce mass dispersion so that only selected ions pass into the next stage.

SUMMARY OF THE INVENTION

It is an object of the present invention to overcome this disadvantage. More particularly, it is an object of the present invention to provide a mass spectrometer having a plurality of ion analyzers including at least one magnetic sector analyzer and a time-of-flight analyzer in which the TOF analyzer can be used to mass analyze ions from the magnetic sector analyzer as well as daughter ions from a collision cell disposed between the magnetic sector analyzer and the TOF analyzer.

In accordance with these objectives there is provided a mass spectrometer comprising an ion source, an ion detector, and, disposed between said ion source and said detector, a plurality of ion analyzers at least one of which is a magnetic-sector ion-momentum analyzer and at least another of which is an ion-mass or ion-momentum analyzer disposed between said magnetic-sector ion-momentum analyzer and said ion detector, said spectrometer being characterised by the provision of bypass means, operable when said magnetic-sector ion-momentum analyzer is not in use, said bypass means comprising a path along which ions may pass from said ion source to said ion-mass or ion-momentum analyzer without passing through said magnetic-sector ion-momentum analyzer.

In a preferred embodiment, said bypass means comprises two ion-beam switching devices disposed one on either side of said magnetic-sector ion-momentum analyzer and an evacuated flight-tube connecting said switching devices and through which ions travel without passing through said magnetic-sector ion-momentum analyzer when said switching devices are in operation. Preferably, when in operation, said switching devices deflect said ions along the path provided by said bypass means by means of an electrostatic field. In this way ions can be transmitted between the source and the ion-mass or ion-momentum analyzer along a linear path without any mass discrimination taking place because they do not pass through a magnetic field.

Conveniently, said ion-mass or ion-momentum analyzer comprises a time-of-flight ion mass analyzer, preferably of the orthogonal acceleration type. Further preferably, collision cell means are provided between said magnetic-sector ion-momentum analyzer and said ion-mass or ion-momentum analyzer to cause fragmentation of ions passing through it by collisions with inert gas molecules contained within said collision cell means.

Advantageously, at least one electrostatic ion-energy analyzer is provided to cooperate with said magnetic-sector ion-momentum analyzer to provide a double-focused (ie, both direction and velocity focused) image at a point between said magnetic-sector analyzer and said ion-mass or ion-momentum analyzer.

Viewed from another aspect, the invention provides a method of mass spectrometry comprising the steps of:

a) generating a beam of ions;

b) passing said beam of ions-through a plurality of ion analyzers, at least one of which is a magnetic-sector ion-momentum analyzer and at least another of which is an ion-mass or ion-momentum analyzer disposed downstream of said magnetic-sector ion-momentum analyzer;

c) detecting at least some ions after they have passed through said plurality of analyzers;

the method being characterised by the additional step of:

d) when said magnetic-sector ion-momentum analyzer is not in use, providing a bypass path along which ions may travel to said ion-mass or ion-momentum analyzer without passing through said magnetic-sector ion-momentum analyzer.

Preferably, the provision of said bypass path comprises the steps of:

a) by means of a first switching device, deflecting said ion beam before it enters said magnetic-sector ion-momentum analyzer through an evacuated flight tube along a linear path which does not pass through said magnetic-sector ion-momentum analyzer; and b) by means of a second switching device, deflecting said ion beam after the ions in it have travelled said linear path to restore it to the direction it would otherwise have taken if it had passed through said magnetic-sector ion-momentum analyzer.

In a preferred method, said first and said second switching devices deflect said ion beam by means of an electrostatic field.

In a still further preferred method, said ion-mass or ion-momentum analyzer is an orthogonal acceleration time-of-flight mass analyzer.

Advantageously, said ion beam is passed into a collision cell to fragment ions contained within it and produce daughter ions which subsequently pass into said ion-mass or ion-momentum analyzer.

It is also advantageous that said plurality of ion analyzers comprises at least one electrostatic ion-energy analyzer which co-operates with said magnetic-sector ion-momentum analyzer to provide a double-focused (ie, both direction and velocity focused) image at a point between said magnetic sector analyzer and said ion-mass or ion-momentum analyzer.

The invention therefore provides a multi-function mass spectrometer which can be used as a highly efficient MS/MS instrument having a high-resolution first stage and an orthogonal-TOF analyzer for high-efficiency analysis of the daughter ions produced by fragmentation of the ions of any given mass-to-charge ratio selected by the first stage. Alternatively, if the bypass means is in operation, the orthogonal TOF analyzer can be used to efficiently mass analyze the ions produced by the ion source. This mode is particularly useful for the analysis of very high mass ions produced, for example, by an electrospray ion source or by a pulsed ion source such as a matrix-assisted laser desorption source (MALDZ).

BRIEF DESCRIPTION OF THE DRAWINGS

A preferred embodiment of the invention will now be described in detail by way of example only and with reference to the figures, wherein.

DETAILED DESCRIPTION OF THE INVENTION

Figure 1:
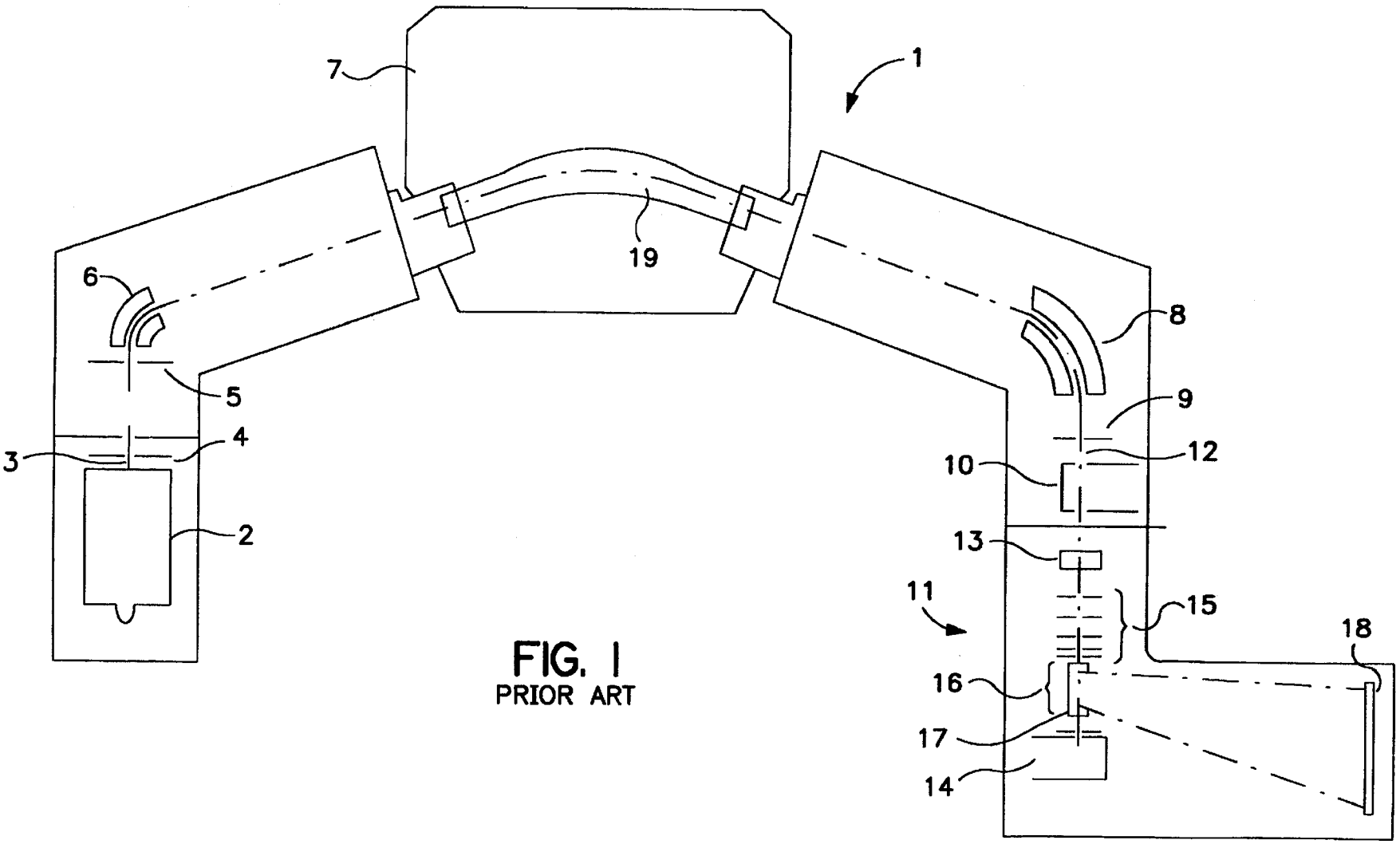
FIG. 1 PRIOR ART
FIG. 1 is a schematic diagram showing a prior art ion-momentum analyzer and an orthogonal. TOF mass spectrometer having a magnetic-sector analyzer.
Figure 2:
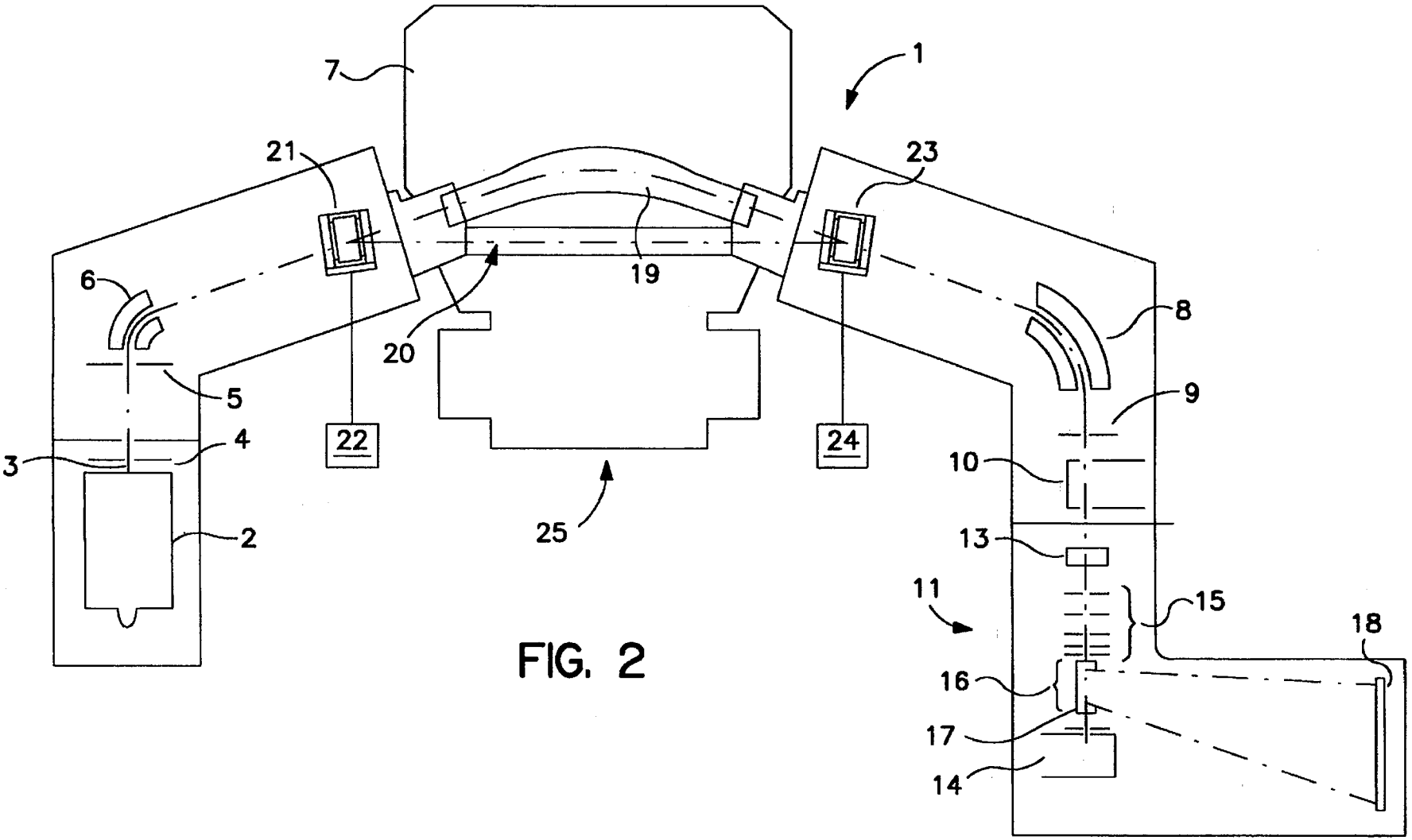
FIG. 2 is a schematic diagram showing a mass spectrometer having magnetic-sector ion-momentum analyzer and an orthogonal TOF analyzer which is constructed in accordance with the present invention.

The mass spectrometer shown in FIG. 2 is similar in many respects to the prior art spectrometer shown in FIG. 1, and corresponding parts are represented by the same reference numbers.

FIG. 2 shows a mass spectrometer 1 according to the invention. It comprises an ion source 2, an ion detector 14, and a plurality of ion analyzers 6, 25, 8 and 11. The analyzer generally indicated by 25 is a magnetic-sector ion-momentum analyzer comprising an electromagnet 7 and an evacuated flight tube 26 disposed between its poles, through which tube ions travel along different curved trajectories (such as that indicated at 19) according to their mass-to-charge ratio. The ion analyzers 6 and 8 are electrostatic cylindrical-sector ion-energy analyzers which cooperate with the magnetic sector analyzer 25 to produce at the collector slit 9 a mass dispersed double-focused (ie, both direction and velocity focused) ion image of a source slit 4 disposed as shown in FIG. 1. The width of the collector slit 9 is adjustable in order to control the resolution of the double-focusing analyzer and hence the range of mass-to-charge ratios of ions transmitted through the collector slit 9, as in the prior mass spectrometer shown in FIG. 1. An alpha-angle defining slit 5 is also provided in order to limit the angular divergence of the ion beam 3 produced by the ion-source 2 so that the resolution of the double-focusing analyzer is not degraded.

An auxiliary ion detector 10 is provided downstream of the collector slit 9 to enable the spectrometer of the invention to be used as a conventional high-resolution double-focusing mass spectrometer and to aid adjustment of the complete instrument. This detector is arranged so that when it is in use, ions are deflected away from the direction in which they are travelling after passing through the collector slit 9 by means of an electrostatic field to strike an ion-sensitive surface such as a multiplier dynode or conversion electrode. When the auxiliary detector 10 is not in use, the electrostatic field is turned off so that ions may pass unobstructed to the next stage of the spectrometer, described below.

In order to permit MS/MS experiments to be carried out, a collision cell 13 is provided downstream of the collector slit 9. Ions having mass-to-charge ratios in a range selected by the width of the collector slit 9 enter the cell and collide with neutral molecules of an inert gas contained within it to produce daughter ions. The energy of the ions as they enter the cell 13 can be controlled by adjustment of the potential of the cell itself. Typically, ions will be generated in the ion source 2 at a potential of between 4000 and 8000 volts and will therefore emerge from the grounded collector slit 9 with a corresponding kinetic energy of between 4000 and 8000 eV. If the potential of the cell 13 is maintained at ground potential, ions will enter the cell with kinetic energies in this range, However, if the cell potential is increased, the energy at which the ions enter will be reduced by a corresponding amount.

Daughter ions produced in the collision cell 13 pass through a deceleration region 15 which comprises a stack of electrodes, the potential on the last of which determines the velocity at which the ions enter the orthogonal TOF analyzer 11. Particularly in the case of collisions of high energy in the cell 13, the daughter ions will emerge from the cell with the same velocity, irrespective of their mass-to-charge ratio, and the potential of the final electrode in the deceleration region 15 is selected to make that velocity suitable for the orthogonal TOF analyzer. The potentials on the remaining electrodes in the region 15 are selected to provide some focusing action and reduce the divergence of the ion beam which characteristically accompanies deceleration. However, if very low energy collisions are used in the cell 13, the amount of deceleration in the region may be small or even zero.

After deceleration, the ions enter an orthogonal TOF analyzer generally indicated by 11 which comprises an extraction region 16 and a repeller electrode 17. By application of a suitable pulsed potential to the repeller electrode 17, packets of ions are ejected orthogonally to reach an ion detector 18 with an extended ion-sensitive surface. The operation of such a TOF analyzer is conventional (see, for example, GB patent 2233149). In the case where the ion source 2 is a pulsed ion source such as a MALDI source, the pulses applied to the repeller electrode 17 are advantageously synchronised with the pulses generated by the ion source 2.

The novel spectrometer of FIG. 2 is distinguished from the prior spectrometer of FIG. 1 by the provision of bypass means which comprise an evacuated straight flight tube 20 and first and second switching devices 21 and 23. The straight flight tube 20 provides a linear path along which ions may travel from the ion source 2 to the orthogonal TOF analyzer 11 without passing through the magnetic field of the magnetic-sector analyzer 25. The switching devices 21 and 23 comprise electrostatic deflection systems which allow the selection of the route taken by ions in the vicinity of the analyzer 25. When the magnetic sector analyzer 25 is in use, the first switching device 21 is not energised so that the ions travel undeflected from the first electrostatic ion-energy analyzer 6 into the flight tube 26 and along curved trajectories (for example 19) according to their mass-to-charge ratios. At least some of these ions then travel undeflected through the second switching device 23 (also not energised) to the second electrostatic ion-energy analyzer 8. When the magnetic sector analyzer 25 is not required, suitable potentials-are applied to the switching devices 21 and 23 by deflection power supplies 22 and 24 respectively, so that the first switching device 21 deflects the ions along a linear path through the straight flight-tube 20 to enter the second switching means 23, which then deflects them further to enter the second electrostatic ion-energy analyzer 8, as shown in FIG. 2. This avoids the need for the ions travelling between the two electrostatic analyzers 6 and 8 to be deflected by a magnetic field and therefore eliminates mass dispersion as the ions travel between the ion source 2 and the orthogonal TOF analyzer 11. Preferably, although the flight tube 20 does not pass between the poles of the electromagnet 7, the current flowing through its coils is switched off to ensure that the ions travelling through the straight flight-tube 20 are not affected by stray magnetic fields.

A particularly suitable arrangement of electrodes for the switching devices 21 and 23 comprises arrays of parallel electrodes disposed above and below the plane in which the ions are travelling, similar to the multi-electrode analyzers taught in U.S. Pat. Nos. 5,198,666 and 5,194,732. An electrode array of this type is particularly suitable because it does not physically obstruct the path of ions of different energies leaving the electrode structure, but any electrostatic deflection system may be employed providing that it does not obstruct either the deflected or undeflected ion beams.

In this way, when the switching devices 21 and 23 are energised, ions from the ion source 2 reach the collision cell 13 without mass discrimination, and may then be collided if required with neutral molecules to produce daughter ions. These daughter ions, or the ions direct from the source 2, arrive at the deceleration region 15 and the orthogonal TOF analyzer 11, which can then be used mass analyze them. As explained, the analysis by an orthogonal TOF analyzer of daughter ions produced by high-energy collisions is particularly effective because all the ions are produced at constant velocity. Similarly, analysis of the very high mass ions which can be produced by an electrospray ionization source can be more effectively performed with a TOF analyzer. Finally, the TOF analyzer is particularly well suited to the analysis of ions from pulsed ion sources such as a MALDI source because synchronisation of its repeller pulses with the ion source pulses ensures that nearly all the ions produced by the source can be effectively mass analysed.

A spectrometer constructed according to FIG. 2 therefore provides a number of different modes of operation in one instrument at a cost considerably less than that of the several different mass spectrometers which might otherwise be required.

I claim:

1. A mass spectrometer comprising an ion source, an ion detector, and, disposed between said ion source and said detector, a plurality of ion analyzers at least one of which is a magnetic-sector ions-momentum analyzer and at least another of which is an ion-mass or ion-momentum analyzer disposed between said magnetic-sector ion-momentum analyzer and said ion detector, said spectrometer being characterised by the provision of bypass means, operable when said magnetic-sector ion-momentum analyzer is not in use, said bypass means comprising a path along which ions may pass from said ion source to said ion-mass or ion-momentum analyzer without passing through said magnetic-sector ion-momentum analyzer.

2. A mass spectrometer as claimed in claim 1 wherein said bypass means comprises two ion-beam switching devices disposed one on either side of said magnetic-sector ion-momentum analyzer and an evacuated flight-tube connecting said switching devices and through which ions travel without passing through said magnetic-sector ion-momentum analyzer when said switching devices are in operation.

3. A mass spectrometer as claimed in claim 2 wherein when in operation, said switching devices deflect said ions along the path provided by said bypass means by means of an electrostatic field.

4. A mass spectrometer as claimed in claim 1 wherein said ion-mass or ion-momentum analyzer comprises a time-of-flight ion mass analyzer.

5. A mass spectrometer as claimed in claim 4 wherein said time-of-flight ion mass analyzer is of the orthogonal acceleration type.

6. A mass spectrometer as claimed in claim 1 wherein collision cell means are provided between said magnetic-sector ion-momentum analyzer and said ion-mass or ion-momentum analyzer to cause fragmentation of ions passing through it by collisions with inert gas molecules contained within said collision cell means.

7. A mass spectrometer as claimed in claim 1 wherein at least one electrostatic ion-energy analyzer is provided to cooperate with said magnetic-sector ion-momentum analyzer to provide a double-focused (ie, both direction and velocity focused) image at a point between said magnetic sector analyzer and said ion-mass or ion-momentum analyzer.

8. A method of mass spectrometry comprising the steps of:

a) generating a beam of ions;

b) providing a plurality of ion analyzers, at least one of which is a magnetic-sector ion-momentum analyzer and at least another of which is an ion-mass or ion-momentum analyzer disposed downstream of said magnetic-sector ion-momentum analyzer;

c) detecting at least some ions after they have passed through at least said ion-mass or ion-momentum analyzer disposed downstream of said magnetic-sector ion-momentum analyzer;

the method being characterised by the additional step of:

d) providing a bypass path along which ions may travel to said ion-mass or ion-momentum analyzer without passing through said magnetic sector ion-momentum analyzer.

9. A method as claimed in claim 8 wherein the provision of said bypass path comprises the steps of:

a by means of a first switching device, deflecting said ion beam before it enters said magnetic-sector ion-momentum analyzer through an evacuated-flight tube along a linear path which does not pass through said magnetic-sector ion-momentum analyzer; and b) by means of a second switching device, deflecting said ion beam after the ions in it have travelled said linear path to restore it to the direction it would otherwise have taken if it had passed through said magnetic-sector ion-momentum analyzer.

10. A method of mass spectrometry as claimed in claim 9 wherein said first and said second switching devices deflect said ion beam by means of an electrostatic field.

11. A method of mass spectrometry as claimed in claim 8 wherein said ion-mass or ion-momentum analyzer is an orthogonal acceleration time-of-flight mass analyzer.

12. A method of mass spectrometry as claimed in claim 8 wherein said ion beam is passed into a collision cell to fragment ions contained within it and produce daughter ions which subsequently pass into said ion-mass or ion-momentum analyzer.

13. A method of mass spectrometry as claimed in claim 8 wherein said plurality of ion analyzers comprises at least one electrostatic ion-energy analyzer which cooperates with said magnetic-sector ion-momentum analyzer to provide a double-focused (ie, both direction and velocity focused) image at a point between said magnetic sector analyzer and said ion-mass or ion-momentum analyzer.

* * * * *